United States Patent [19]

Ponzi et al.

[11] Patent Number: 4,572,252

[45] Date of Patent: Feb. 25, 1986

[54] APPARATUS DESIGNED FOR FILLING CONTAINERS WITH LIQUID/PASTE SUBSTANCES UNDER STERILE CONDITIONS

[75] Inventors: Renato Ponzi, Corcagnano; Martin Ellenberg, Pannocchia, both of Italy

[73] Assignee: El.PO s.r.l., Corcagnano, Italy

[21] Appl. No.: 573,490

[22] Filed: Jan. 24, 1984

[30] Foreign Application Priority Data

Feb. 2, 1983 [IT] Italy ..... 40008 A/83

[51] Int. Cl.[4] ..... B67C 3/02

[52] U.S. Cl. ..... 141/90

[58] Field of Search ..... 141/10, 87, 90, 91; 222/108, 148

[56] References Cited

U.S. PATENT DOCUMENTS 2,874,734 2/1959 Luckock et al. ..... 141/87

4,350,187 9/1982 Trusselle et al. ..... 222/148 X 4,446,674 5/1984 Inada ..... 141/90 X

*Primary Examiner*—Stephen Marcus

*Assistant Examiner*—Mark Thronson

*Attorney, Agent, or Firm*—Laff, Whitesel, Conte & Saret

[57] ABSTRACT

The invention relates to improved apparatus for filling containers with liquid and/or paste substances under sterile conditions, and comprises a filler-valve (1) giving out directly into an enclosed sterile chamber (4) whose bottom-opening (5) affords access to the neck (6) of single containers (7) to be filled. Provision is made for a device (60) which lays hold on the container neck (6) when inserted into the opening (5) thus keeping the same in vertical alignment below the valve (1), and for at least one plate whose function is that of closing-off the opening (5) automatically whenever no container is offered thereto for the purpose of being filled.

5 Claims, 5 Drawing Figures

4
56
53
63
6
13
51
1
VII
60
61
11
9
2
8
10
VII
56
5
52
3
54
57
59
58
55
7

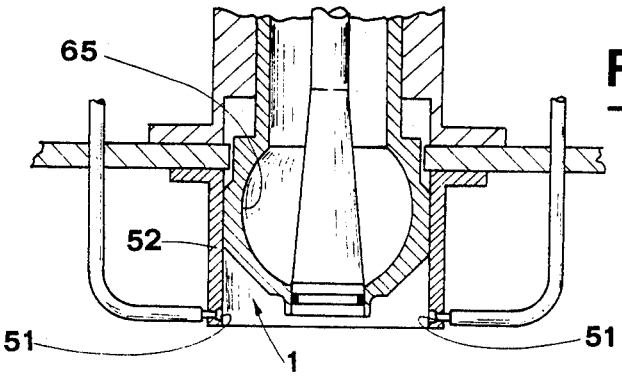
Fig. 4
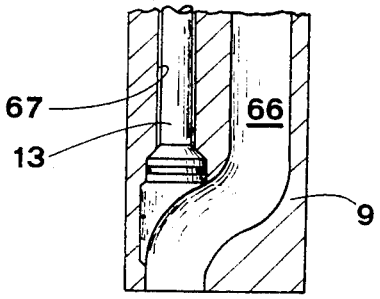
Fig. 5
Fig. 2
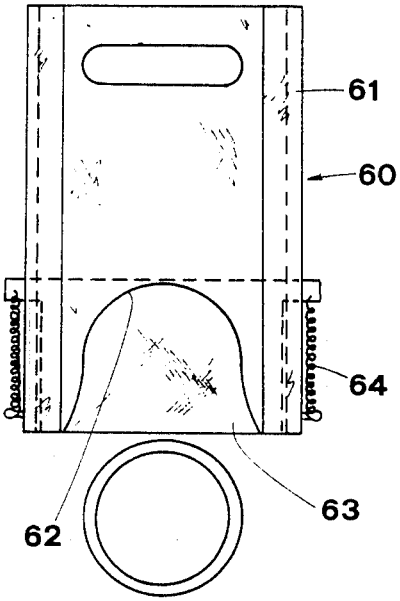
Fig. 3
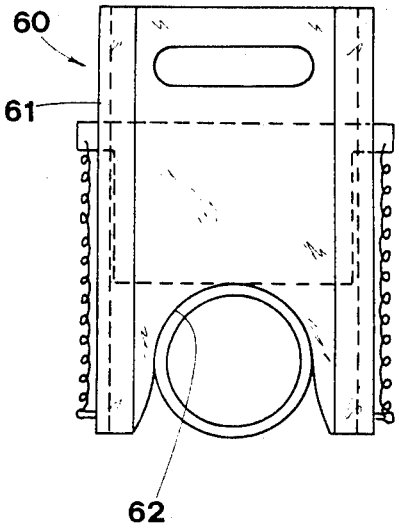

APPARATUS DESIGNED FOR FILLING CONTAINERS WITH LIQUID/PASTE SUBSTANCES UNDER STERILE CONDITIONS

BACKGROUND OF THE INVENTION

The invention described herein relates to improved apparatus designed for batching liquid and/or paste substances into containers under sterile conditions.

Its envisaged—though not exclusive application, is that wherein special bag-type containers are filled with foodstuffs either in the liquid state, or having a paste-like consistency—viz, tomato-pulp etc.

These bag-type containers are provided with an opening located in a cylindrical neck-portion of the bag, to which a plug or cap is subsequently fitted in order to create the necessary hermetic seal.

The main problem connected with the filling of such containers—especially where foodstuffs are concerned—is that of ensuring that the filling operation itself is brought about under genuinely sterile conditions.

A further problem is that of allowing for the cleaning of such parts of the apparatus as are used in filling, valves, and so forth, during the actual work cycle.

An additional problem as touching the embodiment of such apparatus is that of permitting ready and easy access to its principal working parts.

The main object of the invention described herein is that of solving the problems aforementioned, providing apparatus which is both simple in construction, and functional and efficient in operation.

SUMMARY OF THE INVENTION

These objects and others besides are realized by the invention described herein, which relates to improved apparatus, designed for filling containers with liquid and/or paste substances under sterile conditions, and comprising:

a filler-valve capable of movement through a vertical path and provided at bottom with an outlet orifice whose projecting spout inserts to a tight fit within the mouth of a container to be filled;

an enclosed sterile chamber located beneath said filler-valve and having an opening at bottom into which the neck of said container may be introduced;

a device which lays hold on said container neck, thereby keeping it vertically aligned with said filler-valve; and, means bringing about automatic closure of said opening whenever no such container is offered thereto; the apparatus thus composed characterized in that provision is made for a number of nozzles disposed coaxially around and set apart at a short distance from the bottom end of said valve, and designed to jet sterilizer fluid at the valve's said bottom end when in raised position—that is, no longer in contact with the neck of a container; it being envisaged that such nozzles wi11 be located within a bell-housing disposed coaxially with and at the bottom end of a cylindrical tube within which said filler-valve is made to slide; provision being made for a drip-tray beneath said bell-housing, gathering-in both used sterilizer fluid and such particles of foodstuff as are removed from the bottom end of said valve, and for means of suction which will draw off such waste from said drip-tray.

BRIEF DESCRIPTION OF THE DRAWINGS

Further features and advantages of the invention described herein will emerge from the detailed description of a number of embodiments which follows, these illustrated as strictly unlimitative examples with the aid of accompanying drawings, in which:

FIGS. 2 and 3 show two working positions of a detail of the apparatus, seen in section through I—I, FIG. 1;

FIGS. 4 and 5 are sections through further embodiments of the invention, seen in vertical elevation.

DESCRIPTION OF THE PREFERRED EMBODIMENTS

Figure 1:
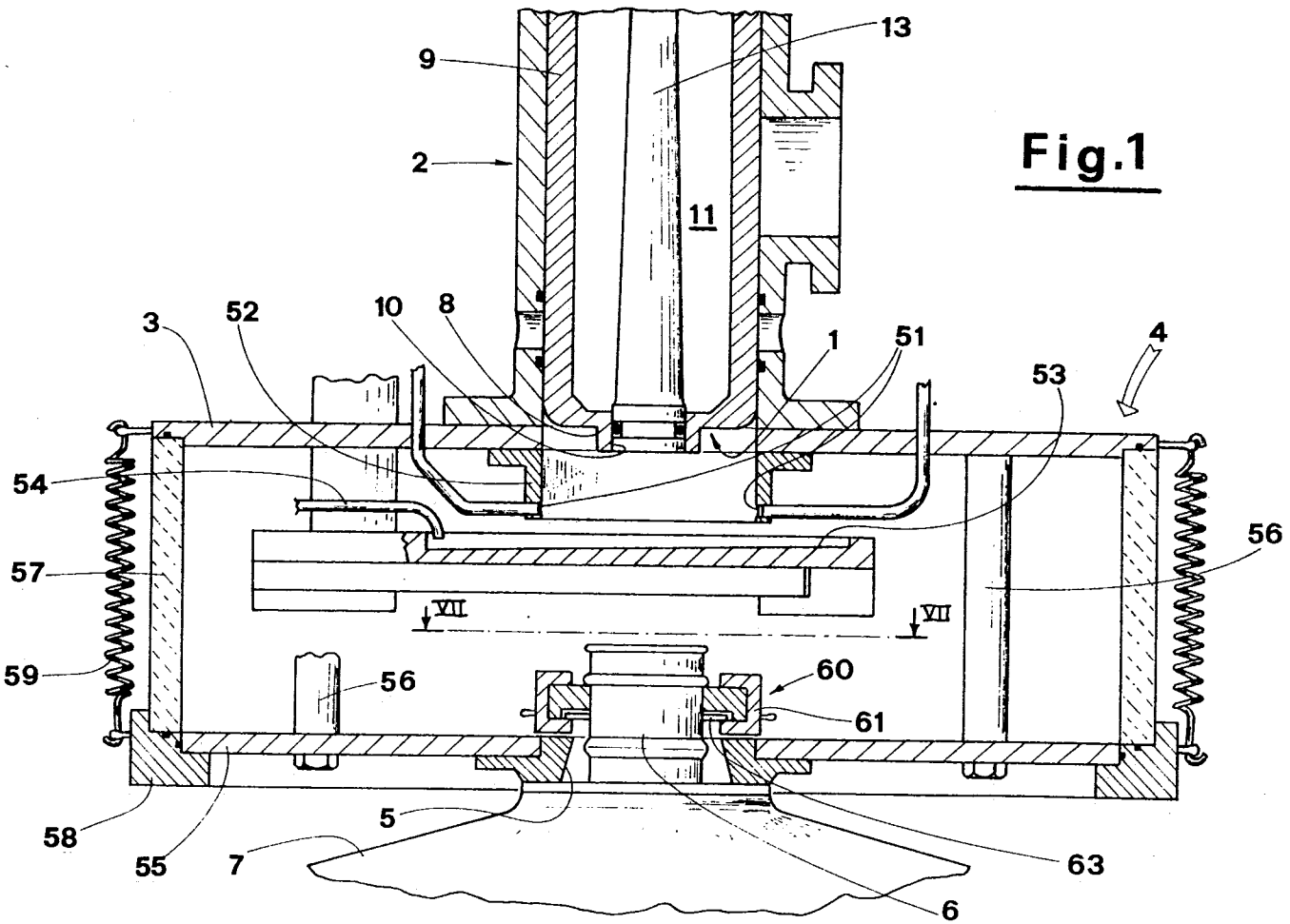
FIG. 1 is the section through a first embodiment of the invention, in vertical elevation.

With reference to the drawings, 1 denotes the filler-valve as a whole, this being capable of movement through a vertical path within a fixed cylindrical tube 2. The tube itself is fixed at right-angles to the flat top-side 3 of an enclosed sterile chamber 4 having an opening 5 at bottom designed to admit the neck 6 of a container 7 to be filled. The filler-valve is provided at bottom with an outlet orifice 10 whose projecting spout 8 inserts to an exact fit within the neck 6 of a container 7, whilst comprising: a cylindrical core 9 having an inner cavity 11 and an inlet 12 at one side through which to admit the foodstuff; a movable obturator 13 disposed coaxially within said cylindrical core 9 and designed to block off the valve's outlet orifice 10.

In the embodiments illustrated in FIGS. 1 and 4, one has coaxially-disposed nozzles 51 set apart and at a slight distance from the bottom end of filler-valve 1, whose function is that of jetting sterilizer fluid at said bottom end once the valve itself is in "raised" position—i.e. no longer in contact with said container-neck 6. The nozzles 51 themselves are located within a bell-housing 52, this disposed coaxially with and at the bottom end of said cylindrical core 9 wherein said filler-valve 1 is caused to raise and lower. At a slight distance beneath said bell-housing 52 one has a drip-tray 53 which will gather up both the sterilizer fluid and any traces of foodstuff removed from the valve's bottom end by the jet from said nozzles 51. A suction pump (not shown in the drawing) provides for removal of waste from the drip-tray 53 by drawing-off through suction-tube 54.

The drip-tray 53 is located in the top of a device 35 which provides for removal and subsequent replacement of the plug or cap from and into/onto the container neck 6 offered thereto through said bottom-opening 5 and into chamber 4 for filling. The inclusion of a bell-housing 52 in the embodiment preferred and set forth, permits wash-down of the valve's bottom end by fluid-jet (vapor, for instance) when sterilizing, in isolation from the rest of said enclosed chamber 4. Bell-housing 52 illustrated in fact provides a side-baffle whose function is that of ensuring that both sterilizer and waste particles removed from the valve bottom will be kept within the space allowed by the housing and thus drop nicely into the drip-tray 53 beneath.

Access to the interior of enclosed chamber 4 is made extremely simple by virtue of the way the chamber itself is constructed. The flat top 3 is united with its opposite number at the chamber bottom 55 by way of studs 56. A cylindrical side wall 57 fashioned in transparent material creates the sterile enclosure that is chamber 4, and may be slid out coaxially from the bottom thereof with respect to top and bottom components 3 and 55. The side-wall thus embodied 57 is kept in position both by fluid/airtight association with top 3 and bottom 55, and by the addition of a hoop 58 located coaxially about the lower edge of the wall itself, being urged thereagainst by means either of springs 59 or tie-bolts anchored at top-side 3; whichever the method, removal of side-wall 57 is made abundantly simple with no more required than the removal of said hoop 58.

In the embodiment shown in FIG. 1, alignment and steadying of the single container-neck 6 with respect to the vertical axis of valve 1 when introduced into bottom-opening 5 may be accomplished by a device 60 which comprises an element 61 made to traverse back and forth along an axis normal to that of said bottom opening 5; the element 61 itself exhibiting a recess 62 at one end, shaped so as to make contact with the neck 6 of a single container 7 offered to bottom-opening 5 by sliding across to embrace that portion which projects upward into the chamber when inserted.

In this way, element 61 urges against the neck 6 of the container, locking it fast against the opposing side of bottom-opening 5.

In order to keep the opening closed during those intervals when no container neck 6 is brought to bear for the purposes of filling, one has a plate 63 disposed parallel with and as close as possible to the chamber bottom 55, likewise traversing along an axis normal to that of said bottom-opening 5. Positioned thus, plate 63 is rendered movable by sliding with respect to the element 61 itself, associated therewith by spring means in such a way that the opening may be kept closed off during those intervals when no container-neck 6 is inserted for the purposes of filling. When, on the other hand, a container-neck 6 is inserted, said plate 63 in no way hinders the approach of element 61 toward the neck of the container, nor location of its recess 62 thereabout, since the plate itself—once having made contact with the outside wall of said container-neck 6—is able to slide with respect to element 61 in the opposite direction to that along which element 61 approaches opening 5, overcoming the resistance of a return spring 64 in so doing.

A further embodiment of the invention, shown in FIG. 4, envisages a widening-out of cavity 11 at the point where this conjoins with said outlet orifice 10. Denoted 65 in the drawing, this feature is incorporated with the end in view of easing the outflow of particularly dense foodstuffs during the batching-stage proper.

A further embodiment still, shown in FIG. 5, eases said outflow by means of an independent duct 66 in place of the inner cavity 11 aforedescribed, this located within cylindrical core 9 and to one side of obturator 13, able to slide axially in its own seating 67. After turning through a double bend, said duct 66 gives out through orifice 10 which is located coaxially with respect to the sliding obturator 13, as aforesaid.

Numerous modifications of a practical nature may be applied to the constructive particulars of the invention thus described without by any means straying from within the sphere of protection afforded to the concept behind the invention as claimed hereinafter.

What is claimed:

1. An apparatus for filling a container having a neck with liquid and/or paste material under sterile conditions comprising:

an enclosed chamber, said chamber having a top and a bottom, the bottom of said chamber defining an opening into which the container neck may be introduced;

a cylindrical tube located at said top of said chamber and communicating with the interior of said enclosed chamber;

a filler valve vertically reciprocable within said cylindrical tube and within said chamber, said filler valve having a projecting spout at one end and said spout being insertable within said container neck, said projecting spout defining an outlet orifice to allow said material to pass through said orifice into said container when said container is to be filled;

a device which holds the container neck when the neck is introduced into the chamber bottom opening to maintain the container in vertical alignment with said filler valve;

means to close off said chamber bottom opening automatically whenever the container neck is not in the chamber bottom opening;

a bell-housing mounted within said chamber and disposed coaxially with said cylindrical tube and sized to permit the valve to slide vertically therethrough;

a plurality of nozzles located within said bell-housing and set to jet sterilizer fluid at said spout when the valve is raised out of contact with the container;

a drip-tray beneath said bell-housing, said drip-tray designed to gather both used sterilizer-fluid and particles removed from the valve; and suction means positioned to draw off the fluid and material collected by said drip-tray.

2. Apparatus as in claim 1 wherein the device which holds the container neck comprises an element capable of traversing back and forth along an axis normal to that of said bottom-opening; said element defining a recess at one end shaped so as to breast with the container neck; a plate slideably mounted on said element, said plate disposed perpendicular to said bottom-opening and slideable with respect to said element and a spring attached to said plate to hold said plate in a position to normally close said bottom opening.

3. Apparatus as in claim 1 wherein said enclosed chamber comprises:

a top side united by way of studs with a bottom side disposed parallel thereto; and a transparent cylindrical side-wall removable by sliding downwards coaxially with respect to said top and bottom and held in position by means of a hoop and a spring, said hoop located coaxially with the side wall about its lower edge, urged thereagainst by said spring which duly urges side-wall itself against the rim of said top side.

4. Apparatus as in claim 1 wherein said filler-valve has a widened-out inner cavity portion located at the point-of-association with said orifice.

5. Apparatus as in claim 1 wherein said filler valve has a central core which includes a double bend duct passage and a vertically moving obturator spaced from one bend of said duct; said duct, after making a given bend away from the vertical, terminating in the outlet orifice; and said obturator is made to move in coaxial fashion with said outlet orifice.

* * * * *